US005174455A

United States Patent [19]

Zelazny et al.

[11] Patent Number: 5,174,455

[45] Date of Patent: Dec. 29, 1992

[54] COARSE PARTICLE SEPARATOR FOR TONER PARTICLES

[75] Inventors: Joseph S. Zelazny, Webster; Lewis S. Smith, Fairport; Thomas W. O'Connor, Pittsford, all of N.Y.

[73] Assignee: Xerox Corporation, Stamford, Conn.

[21] Appl. No.: 786,197

[22] Filed: Oct. 31, 1991

[51] Int. Cl.[5] ..... B07B 9/00

[52] U.S. Cl. ..... 209/29; 209/28; 209/138

[58] Field of Search ..... 209/28, 29, 36, 37, 209/138, 139.1, 143, 250

[56] References Cited

U.S. PATENT DOCUMENTS

| | | | |
|---|---|---|---|
| 1,661,299 | 3/1928 | Peron | 209/29 |
| 2,589,957 | 3/1952 | Pearman et al. | 209/28 |
| 2,711,247 | 6/1955 | Hills | 209/29 |
| 2,729,330 | 1/1956 | Newirth | 209/138 |
| 4,127,476 | 11/1978 | Iannazzi | 209/138 X |
| 4,132,634 | 1/1979 | Rumpf et al. | 209/136 |
| 4,304,360 | 12/1981 | Luhr et al. | 241/5 |
| 4,551,240 | 11/1985 | Beppu et al. | 209/143 |
| 4,743,363 | 5/1988 | Darrow | 209/138 |
| 4,802,977 | 2/1989 | Kanda et al. | 209/143 |
| 5,103,981 | 4/1992 | Abbott et al. | 209/37 |

FOREIGN PATENT DOCUMENTS

| | | | |
|---|---|---|---|
| 1238318 | 10/1986 | Japan | 209/28 |
| 0632404 | 11/1978 | U.S.S.R. | 209/28 |

*Primary Examiner*—D. Glenn Dayoan
*Assistant Examiner*—James R. Bidwell
*Attorney, Agent, or Firm*—Oliff & Berridge

[57] ABSTRACT

A coarse particle separator for separating and collecting coarse toner particles having a size greater than substantially 500 microns comprises a tank having an inlet and an outlet, the separation being performed within the tank. The inlet to the tank is located at a lower portion of the tank and is connected to an eductor station by an eductor line. Particles are introduced to the inlet by the eductor line at a velocity of approximately 4500 ft/min. The separation of coarse and light toner particles can be performed by reducing the flow velocity so the coarse particles settle out by their own weight. A flow baffle made of a 75 micron screen hinders the passage of coarse particles. The outlet outputs light toner particles to at least one toner storage bin. Alternatively, the tank can have a conical-shaped upper portion which induces a cyclone effect in the flow of toner particles, the cyclone effect resulting in the collection of coarse particles in the lower portion of the tank. The apex of the conical-shaped upper portion terminates in the outlet. The inlet is located at a side of the tank such that a clearance is provided below the inlet for collection of the coarse toner particles.

17 Claims, 2 Drawing Sheets

COARSE PARTICLE SEPARATOR FOR TONER PARTICLES

BACKGROUND OF THE INVENTION

1. Field of the Invention

The present invention relates to a coarse particle separator for separating and collecting coarse particles and, more particularly, to a coarse particle separator for separating and collecting coarse particles having a size greater than approximately 500 microns.

2. Description of the Related Art

Image formation processes commonly use toner particles in the development stage of the image formation. To obtain a quality image, the toner particles used in the development stage must fall within an acceptable range of particle sizes.

When providing toner particles within a prescribed particle size range, unacceptable particles must be separated out to yield toner particles having an appropriate particle size. Such unacceptable particles include coarse particles which often have a mass as great as 125,000 times as great as the mass of an acceptable toner particle.

In conveying the toner particles for packaging, an effective system for separating out coarse particles is required.

U.S. Pat. No. 4,304,360 to Luhr et al. discloses a process for the manufacture of xerographic toner and for particle classification using a cyclone separator whose exit duct length is controlled to achieve lower particle size classification by causing particles below a five micron diameter to exit the separator through an upper exit duct. The finished product exits through a lower output port. The reference further discloses a coarse classifier. The coarse classifier's incoming material is directed upward toward the bottom of a cone-shaped rotor having radial fins. Larger particles are accelerated to the classifier's annular wall. Finer particles migrate through the rotors fins with a rising air stream and pass out of the classifier by way of an exit duct. The large particles fall down through a chamber. A rotary valve is continuously operated to supply the particles for further grinding. Secondary air is further supplied to the classifier by way of a blower. The device requires that rotor speed be monitored and controlled in order to obtain acceptable toner particles.

U.S. Pat. No. 4,802,977 to Kanda et al. discloses a process for classifying toner particles for developing electrostatic images with accurate particle size distribution. A reduced pressure is generated in a classifying chamber which is divided into at least three sections including a coarse powder section having a first outlet for withdrawing coarse particles, a second outlet for withdrawing medium particles and a third outlet for withdrawing fine powder. A reduced pressure is applied to the chamber through at least one of the first to third outlets.

U.S. Pat. No. 4,132,634 to Rumpf et al. discloses a method and apparatus for sifting particulate material in a cross current where all of the particles of the same size are propelled transversely at the same velocity with the same direction.

U.S. Pat. No. 4,551,240 to Beppu et al. discloses an apparatus for classifying various kinds of particles of different sizes with air currents. The particles are provided with forces of inertia differing from one another depending upon size. The flow of air current constitutes a flow adjusting air current layer interposed between walls defining the main and subsidiary passages and the particular material conveyed by the air currents.

A coarse particle separator is desired which has the ability to separate unacceptable toner particles, thereby improving the product quality, yield and packaging throughout as toner particles are being processed and packaged.

OBJECTS AND SUMMARY OF THE INVENTION

One object of the present invention is provide a coarse particle separator which accurately separates coarse particles from fine toner particles.

Another object of the present invention is to provide a coarse particle separator which does not hinder a toner packaging operation.

Another object of the present invention is to provide a coarse particle separator which does not require close monitoring and control.

A further object of the present invention is provide a coarse particle separator which can easily be utilized in a toner packaging system.

To achieve the foregoing and other objects and to overcome the shortcomings discussed above, a coarse particle separator is provided which separates and collects coarse particles having a size greater than substantially 500 microns. The separator comprises a tank having an inlet and an outlet, the separation being performed within the tank. The inlet to the tank is located at a lower portion thereof and is connected to an eductor station by an eductor line. Particles are introduced to the inlet by the eductor line at a velocity of approximately 4500 ft/min. The separation of coarse particles can be performed by reducing the flow velocity so the coarse particles settle out by their own weight. A flow baffle made of a 75 micron screen hinders the passage of coarse particles. The acceptable toner particles are output from the outlet of the tank to at least one toner storage bin. Alternatively, the tank can have a conical-shaped upper portion which induces a cyclone effect in the flow of toner particles, the cyclone effect resulting in the collection of coarse particles in the lower portion of the tank. The apex of the conical-shaped upper portion terminates in the outlet. The inlet is located at a side of the tank such that a clearance is provided below the inlet for collection of the coarse particles.

DETAILED DESCRIPTION OF THE DRAWINGS

Figure 1:
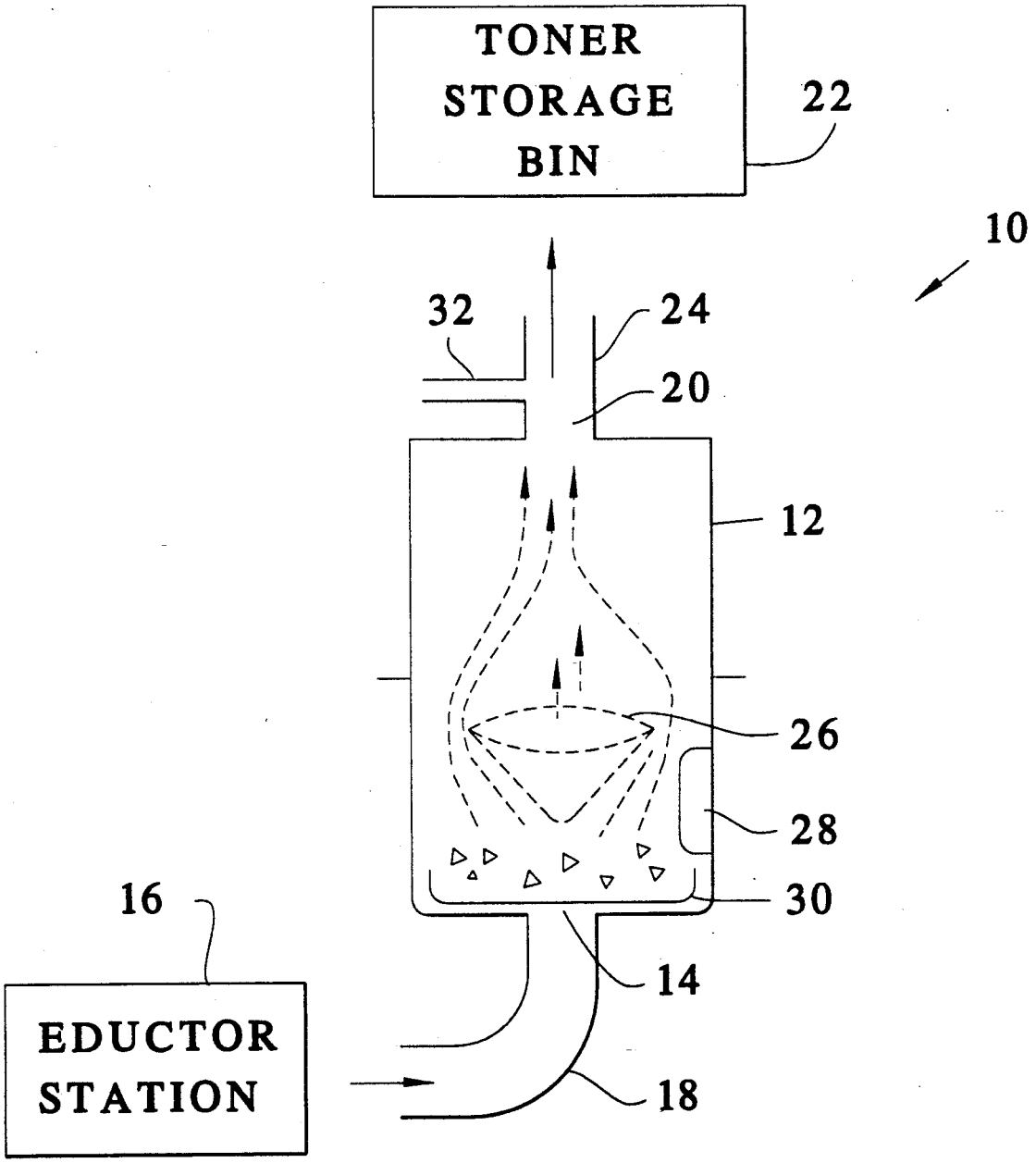
Figure 2:
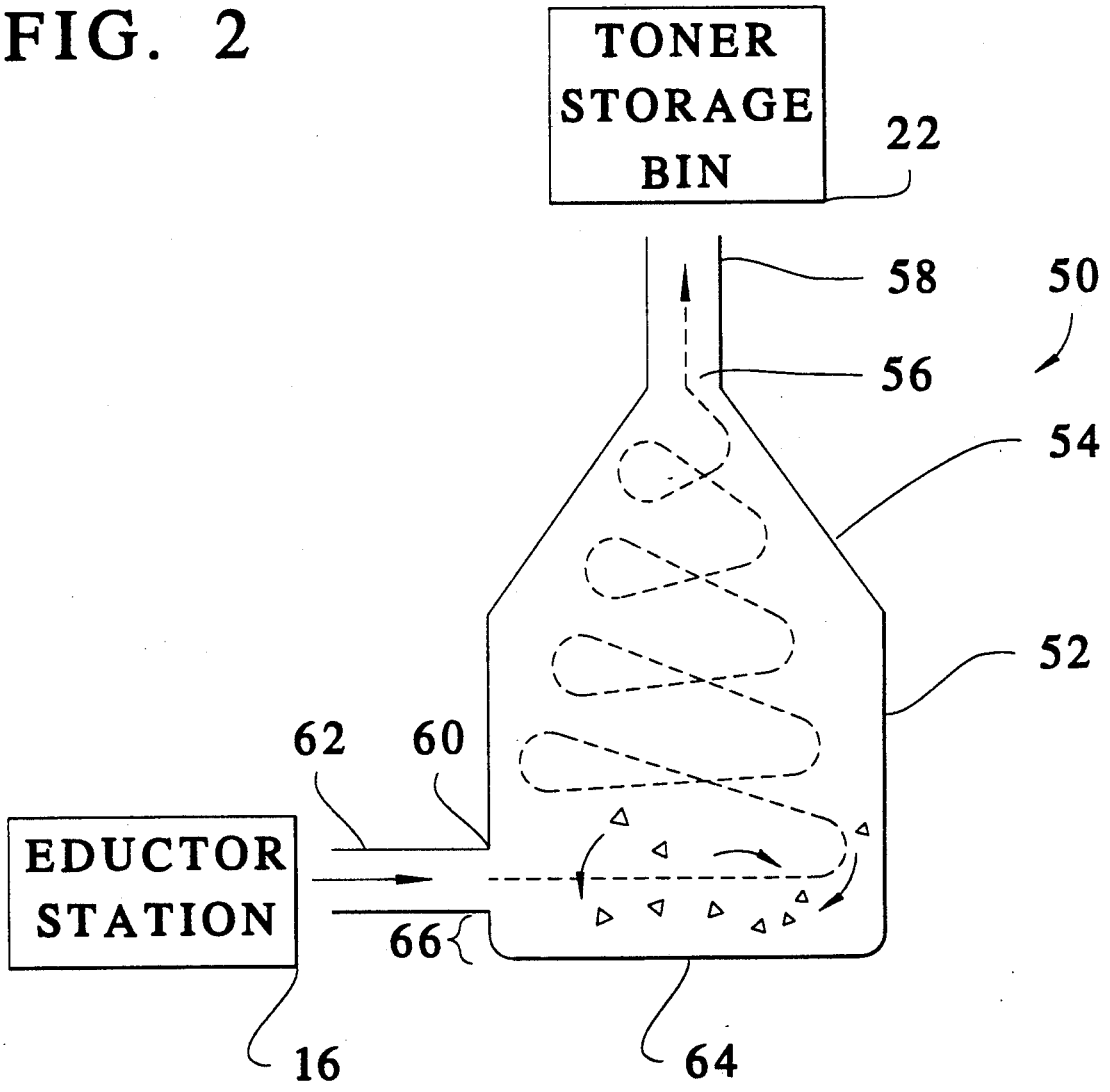

The invention will be described in detail with reference to the following drawings in which like reference numerals refer to like elements and wherein:

FIG. 1 illustrates a coarse particle separator in accordance with a first embodiment of the present invention; and FIG. 2 illustrates a coarse particle separator in accordance with a second embodiment of the present invention.

DETAILED DESCRIPTION OF PREFERRED EMBODIMENTS

Referring now to the drawings, and particularly to FIG. 1 thereof, a coarse particle separator 10 is described. Coarse particle separator comprises a tank 12 having an inlet 14 and an outlet 20. Tank 12 preferably has a volume of approximately 5 cubic feet and a diameter of no less than 1 ft., tank 12 being preferably formed of stainless steel. Inlet 14 is connected to an eductor station 16 by way of an eductor line 18 having a diameter of approximately 3 inches. Outlet 20 is connected to at least one toner storage bin 22 by an output line 24 having a diameter of approximately 3 inches.

Educator station 16 causes toner particles to be conveyed therefrom to inlet 14 by way of eductor line 18. The toner particles are blown through the eductor line 18 such that the velocity of the particles traveling through eductor line 18 is approximately 4500 feet per minute, each particle having its own respective force in proportion to its velocity and mass.

The mean size of a toner particle is 10 microns, the toner having a volume of approximately 525 cubic microns. In contrast, the mean size of an unacceptable coarse particle is 500 microns with a volume of approximately 65,625,000 cubic microns.

The coarse particle separator 10 utilizes the critical suspension velocity (V) in its separator performance, since V for acceptable toner particles is considerably less than V for coarse particles. In utilizing V, the coarse particle separator 10 reduces the velocity of the particle travel below a critical coarse particle suspension velocity. As the particles travel inside tank 12 through inlet 14, large, coarse particles fall to the bottom while lighter acceptable toner particles continue to travel to outlet 20. As particles exit outlet 20, the particles flow through output line 24 to toner storage bin 22.

A 75 micron screen baffle 26 is located within tank 12, screen 26 distributing the air flow through tank 12 and increasing the efficiency of the separation operation performed therein. Screen 26 hinders the passage of coarse particles, thus causing the coarse particles to settle to the bottom of tank 12.

A removable bottom catch tray 30 can be provided within tank 12 to facilitate removal of all of the coarse particles separated and collected within tank 12. Access to the interior of tank 12 can be provided by a door 28 located in a wall of tank 12.

Output line 24 can optionally be sized approximately 0.25 inch larger than the input line 18, i.e., approximately 3.25 inches, if back pressure develops in eductor line 18. If backpressure in eductor line 18 continues to adversely affect the separation operation, an air line 32 can optionally be provided in an upper portion of separator 10 at a location between outlet 20 and output line 24. Air line 32 should be small, i.e., approximately 0.25 inch diameter, to provide approximately 40 PSI pressure to assist the flow of acceptable toner particles into toner storage bin 22 by providing an extra pull on the tank interior, thus preventing flow dissipation.

Referring now to FIG. 2, a second embodiment of a coarse particle separator 50 according to the present invention is described. Coarse particle separator 50 comprises a tank 52, an upper portion 54 of which has a conical-shape terminating in an apex defining an outlet 56. Particles are introduced to an inlet 60 of tank 52 by way of eductor line 62 at a velocity of approximately 4500 feet per minute. Inlet 60 is located in a sidewall of tank 52 at a location approximately 3 inches above the bottom 64 of tank 52. The three inch clearance 66 provides a location in tank 52 for the collection of separated coarse particles.

The shape of tank 52 causes a cyclone effect on the flow of particles, the cyclone effect resulting in large, coarse particles falling to the bottom of tank 52. The lighter, acceptable toner particles continue to travel through outlet 56 to toner storage bin 22 through output line 58. An air line similar to air line 32 discussed above with respect to separator 10 additionally can be provided to assist the flow of toner particles.

The coarse particle separator of the present invention enables separation and collection of large, coarse particles which are generally 50 times greater in size than the size of an acceptable toner particle. The coarse particles which can be collected in accordance with the present invention can comprise fused toner particles greater than approximately 500 microns and/or any other type of contamination having a particle size greater than approximately 500 microns.

The following calculations were used in determining the critical suspension velocity for particle size separation. The calculations take into account both tank size and eductor pressure, i.e., toner transport speed.

CALCULATIONS ON DRAG FLOWS AROUND SPHERICAL PARTICLES (REF: BIRD, STEWART AND LIGHTFOOT, TRANSPORT PHENOMENA, WILEY, 1960)

$f=24/Re$ $\quad Re<0.1$ $\quad Re=D_p\rho f/\mu$ $f=18.5/Re^{(3/5)}$, $\quad 2<Re100$ $f=0.44$, $\quad 500<Re<200,000$ $$f/Re=(4g(\rho_p-\rho f))/(3\rho_f^2V^3) \qquad (1)$$

| | | |
|---|---|---|
| $\rho_p$(particle density) | 1.17 | $g/cm^3$ |
| $\rho_f$(fluid density) | 0.0012 | $g/cm^3$ |
| $\mu$(fluid viscosity) | 0.000183 | g/sec/cm |
| g(gravitational acceleration) | 980 | $cm/sec^2$ |
| V (particle velocity relative to the fluid) | | |
| $D_p$ | | |

Assume a Re, calculate V from Equation (1)
Then calculate a particle diameter from V and Re

| Assumed Re | 19025 | | |
|---|---|---|---|
| | V,cm/sec | V,fpm | $D_p$,μm |
| 500<Re<200K | 2032.15 | 4000.29 | 14277.08 |

At 4000 FPM, a particle would have to be 15 mm in diameter to settle.

| Assumed Re | 32 | | |
|---|---|---|---|
| | V,cm/sec | V,fpm | $D_p$,μm |
| 2<Re<500 | 139.00 | 273.63 | 351.07 |

At 250 FPM, a particle of 350 μm would settle.

In accordance with the above calculations, the preferable input velocity and tank size were determined.

The coarse particle separator according to the present invention facilitates the separation of giant toner particles which remain incorporated with toner particles used in development, adversely affecting the quality of resultant copies. Such giant particles commonly become trapped between a photoreceptor and development roller, rub against the photoreceptor and leave a deposit which is not removed by a cleaner. A smear commonly results which causes an electrostatic image which is developed on subsequent passes.

The coarse particle separator thus separates the unacceptable particles from the toner, thereby improving the product quality, yield and packaging throughput.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A coarse particle separator for separating and collecting coarse particles, said separator comprising:

a tank having a lower inlet for receipt of particles and an upper outlet for output of light toner particles, said inlet having a diameter of substantially 3 inches, said inlet being connected to an eductor station by an eductor line, said eductor line introducing said particles at a velocity of approximately 4500 ft/min.;

separating means located within said tank, said separating means separating coarse particles having a size greater than substantially 500 microns from light toner particles, said coarse particles and said light toner particles being received at said lower inlet, said separating means causing the coarse particles to settle and collect in a bottom portion of said tank; and an air line connected to an upper portion of the separator at a location above the upper outlet, said air line providing pressurized air flow at a pressure of approximately 40 psi to assist the light toner particles in traveling to said outlet.

2. The separator according to claim 1, wherein said outlet has a diameter of substantially 3 inches, said outlet being connected to at least one toner storage bin.

3. The separator according to claim 1, wherein said outlet has a diameter of substantially 3.25 inches, said outlet being connected to at least one toner storage bin, said eductor line having a back pressure therein.

4. The separator according to claim 1, wherein said eductor line is stainless steel.

5. The separator according to claim 1, wherein said tank is stainless steel and has a volume of approximately 5 cubic feet and a diameter of approximately 1 foot.

6. The separator according to claim 1, wherein said tank has a removable bottom catch tray for collection of coarse particles.

7. The separator according to claim 1, wherein said tank has access means for providing access to an interior of said tank for removal of the collected coarse particles.

8. The separator according to claim 1, wherein said separating means comprises a 75 micron screen baffle located in a lower half of said tank, said screen hindering passage of coarse particles to an upper half of said tank.

9. The separator according to claim 1, wherein said tank has a conical-shaped upper portion, an apex of said upper portion terminating in said outlet, said inlet being provided at a side of said tank at a location approximately 3 inches above a bottom of said tank to provide a clearance for collection of coarse particles.

10. A coarse particle separator for separating and collecting coarse particles, said separator comprising:

a tank having an upper portion and a lower portion, an inlet being provided at a bottom of said lower portion, said inlet being connected to an eductor station by an eductor line, said eductor line introducing coarse particles and light toner particles to said inlet, said coarse particles having a size greater than substantially 500 microns, an outlet being connected to a top of said upper portion, said outlet being connected to at least one toner storage bin, said outlet providing output of light toner particles;

a 75 micron screen baffle located in said lower portion of said tank, said screen hindering passage of coarse particles to the upper portion of said tank; and an air line connected to an upper portion of said separator at a location above said outlet, said air line providing pressurized air flow at a pressure of approximately 40 psi to assist the light toner particles in traveling to said outlet.

11. The separator according to claim 10, wherein said tank has a door provided in a side thereof, said door enabling access to an interior of said tank for removal of the coarse particles.

12. The separator according to claim 10, wherein said tank has a removable bottom catch tray for collection of coarse particles.

13. The separator according to claim 10, wherein said eductor line is stainless steel and has a diameter of substantially 3 inches, said eductor line introducing said particles to said inlet at a velocity of approximately 4500 ft/min..

14. The separator according to claim 10, wherein said outlet has a diameter of substantially 3 inches.

15. The separator according to claim 10, wherein said outlet has a diameter of substantially 3.25 inches, said eductor line having a back pressure therein.

16. The separator according to claim 10, wherein said tank is a stainless steel vessel having a volume of approximately 5 cubic feet and a diameter of approximately 1 foot.

17. A coarse particle separator for separating and collecting coarse particles, said separator comprising:

a tank having a conical-shaped upper portion, an apex of said conical-shaped portion terminating in an outlet having approximately a 3.0–3.25 inch diameter, said tank also having a bottom portion; and an inlet provided in a side of said bottom portion at a location above a bottom of said lower portion, said inlet being connected to an eductor station by an eductor line, said eductor line having substantially a 3 inch diameter, said eductor line introducing coarse particles and light toner particles to said inlet at a velocity of approximately 4500 ft/min., said coarse particles having a size greater than substantially 500 microns, the shape of said tank inducing a cyclone effect between said inlet and said outlet, the cyclone effect resulting in the coarse particles being collected in the lower portion of said tank below said inlet.

* * * * *